US005421153A

United States Patent [19]

Schleicher et al.

[11] Patent Number: 5,421,153

[45] Date of Patent: Jun. 6, 1995

[54] HYDRODYNAMIC PROPULSION DEVICE

[75] Inventors: Ulrich Schleicher, Hersbruck; Wolfgang Schwarz, Nurnberg; Joseph Spurk, Bad Konig, all of Germany

[73] Assignee: Diehl GmbH & Co., Nürnberg, Germany

[21] Appl. No.: 134,092

[22] Filed: Oct. 8, 1993

[30] Foreign Application Priority Data

Oct. 24, 1992 [DE] Germany ..... 42 36 043.9

[51] Int. Cl.[6] ..... B63H 11/00

[52] U.S. Cl. ..... 60/221; 60/205; 440/44; 440/45

[58] Field of Search ..... 60/221, 203.1, 205; 440/44, 45

[56] References Cited

U.S. PATENT DOCUMENTS

| | | | |
|---|---|---|---|
| 2,914,913 | 12/1959 | Zwicky | 440/45 |
| 3,044,252 | 7/1962 | Zwicky | 60/221 |
| 3,163,980 | 1/1965 | Turner | 440/44 |
| 4,744,300 | 5/1988 | Bugiel | 102/291 |

FOREIGN PATENT DOCUMENTS 2058392 5/1972 Germany .

OTHER PUBLICATIONS

Hansa-Schiffahrt-Schiffbau-Hafen, 1960, pp. 2670-2677.

*Primary Examiner*—Richard a. Bertsch
*Assistant Examiner*—William Wicker
*Attorney, Agent, or Firm*—Scully, Scott, Murphy & Presser

[57] ABSTRACT

A hydrodynamic propulsion device possessing an expansion chamber located downstream of a cross-sectional widening for the inflow of a medium which is to be expelled through a discharge nozzle. The propulsion device is constructed as a static propulsion mechanism without movable components, in that the gaseous operating medium is produced in the propulsion device through the reaction of a hydrofuel, such as NaK with water.

10 Claims, 3 Drawing Sheets

HYDRODYNAMIC PROPULSION DEVICE

BACKGROUND OF THE INVENTION

1. Field of the Invention

The present invention relates to a propulsion device; and is particularly directed to a hydrodynamic propulsion device possessing an expansion chamber which is located downstream of a cross-sectional widening of an interior passage for the inflow of a medium which is to be expelled through a discharge nozzle.

2. Discussion of the Prior Art

A propulsion of the type mentioned hereinabove is already known from the disclosure of German Patent No. 34 35 076, as being in the form of a device in the nature of a water-piston or water-column engine, in which periodically generated reaction gas bubbles separate out in a nozzle conduit a portion of the inflowing mass of water, and then eject the portion of the water mass in opposition to the supportive action of an intermittently-operating nozzle. Although this valveless and consequently low-frictionally operating propulsion concept has proven itself capable for high propulsion outputs over short periods of time, notwithstanding the therewith encountered unsteady operating cycles, nonetheless, for the practical use thereof, it evidences a number of disadvantages which result from the discontinuous or intermittent mode of operation. Above all, belonging to these disadvantages are the high levels of noise which are developed and the intense mechanical stresses to which the structure is exposed as a result of the frequent load fluctuations. Moreover, the theoretically attainable degree of efficiency of such a water-piston engine, in actuality, is noticeably reduced due to the fact that comparatively lengthy so-called dead operating periods must be taken into consideration between the ejection of a portion of a water column and the filling of the conduit with the inflow through the nozzle.

SUMMARY OF THE INVENTION

In recognition of these conditions, it is an object of the present invention to provide a propulsion device of generally the type considered herein which, although it is also similarly based on the effect of a reaction product acting on a portion of the incoming flow in a pipe or conduit, will, however, at an improved degree of efficiency, cause a lower stressing of the structure and its surroundings as a result of a continually steady mode of operation.

In accordance with the invention, the foregoing object is essentially attained in that the propulsion device of the type as set forth herein is constructed as a static propulsion mechanism in the absence of any movable components, and in that the gaseous operating medium is produced in the propulsion device through the reaction of a hydrofuel, such as NaK, with water.

This drive or propulsion device operates in a steady-state or in effect continually, and in the absence of any moving parts, through the intermediary of a compressible mixture which is produced during the reaction with the water itself of the smallest-sized drops of hydrofuel which are homogeneously distributed over the cross-section of the water. For this purpose, there is utilized the substance (hydrofuel) which reacts directly with the water which is to be expelled from the conduit within in the region of a widening cross-section of the inflowing water so as to be converted into a compressible multiphase medium through intensive mixing with the smallest-sized reaction gas bubbles. The compressible multiphase medium is thereafter compressed by means of a discharge or outlet nozzle and can be subsequently imparted a slowing down of the speed of the flow; for instance, in a stern diffuser, through an increase in pressure. The mode of operation of the thereby steadily operating device is almost noiseless in nature and also provides the advantages of a lower mechanical stressing of the propulsion structure, and reproducible or controllable operating cycles which can hardly be influenced by the depth-dependent water pressure.

A rapid and homogenous throughput of the water with the smallest reaction gas bubbles is propagated in the mixing region when the inflow is slowed down immediately upstream of the mixing region, and then is subjected to intense turbulence or swirling within the short mixing region itself through injection nozzles for the hydrofuel which are distributed over the entire cross-section, whereby the hydrofuel is expelled from the nozzles with substantial components thereof directed in a direction opposite to that of the incoming flow. The higher the pressure differential at which the hydrofuel is injected into the mixing region, the finer become the drops which are to be dispersed within the water which swirls within the mixing section due to the presence of obstructions to the flow.

The liquid hydrofuel can be injected directly into the mixing section either axially-parallel with the longitudinal axis of the mixing section and/or in a radially directed orientation. However, the hydrofuel can also have been brought into a partial reaction in a pre-combustion chamber, so that reaction gases are injected together with stoichiometrically excess amounts of hydrofuel (not yet oxidized) in order to produce a compressible three-phase flow. The constituents of this reaction partner, which are still susceptible to reactions, then expediently react with fresh water in the mixing section itself, wherein the latter is introduced at the outlet end downstream of the mixing section through a pressurized conduit or from a supply tank such that, to a certain extent due to the effect of a post-combustion, this increases the energy content of the flow which is then compressible therein. In general, the reactivity of the hydrofuel which is injected into a pre-combustion chamber or directly into the water can also be increased through heating (for example, inductive heating).

A sufficiently lengthy reaction period in the mixing section is obtained when the hydrofuel is injected into the water in a direction opposite the direction of the incoming flow and/or in a region providing for a reduced flow velocity. The geometry of the injection nozzle and pressure conditions are such as to produce hydrofuel droplets which are as small as possible to enable them to disperse in the water more homogeneously and rapidly, and due to a reproducible or controllable configuration, lead to a reaction which is substantially independently controllable of the pressure conditions in the water, in contrast with large-sized hydrofuel drops. Moreover, with excessively large drops there is encountered the danger that an ignitable explosive gas can be formed in the mixing section.

Through the reaction of the hydrofuel with the water, there is produced a compressible (three-phase) flow which, in contrast with the conditions encountered in the incompressible flow of water, can then operate in the nature of a subsonic jet propulsion mechanism, and which also affords the advantage of reducing any frictional losses by the water at the tail or stern end of the nozzle walls.

Whereas in the propulsion device according to German Patent No. 34 35 076, and pursuant to German Patent No. 34 35 075, a solid reactant in conjunction with an additional liquid reactant delivers a reaction product into the water in order to produce a separation and displacement of a water piston or column; in contrast therewith, pursuant to the present invention this preferably involves the use of a reaction partner which reacts directly with the water, and which, due to a liquid consistency which provided in the interest of obtaining a rapid through-mixing, can be injected in a large volume into the slowed-down and swirled feed flow. Particularly advantageous in this case has been proven to be the employment of eutectically mixed sodium with potassium, which is inexpensively available as a liquid alloy utilized for reactor cooling on a large technological scale. The high level of reactivity of $NaK_x$; in essence, also causes a very rapid corrosion to take place in the structural members which come directly into contact therewith. However, especially in the case of bodies which are designed to travel submerged in water for only single-time military uses; for example, in the instance of torpedoes, this is not considered to be problematic. In the event of a specialized situation of use, in which the above-mentioned susceptibility to corrosion may become critical, it is also possible to have recourse to the employment of the intermetallic compound $NaK_2$ which is similarly present in a liquid state at normal ambient temperatures, and which is also adapted for the injection of fine jets into the mixing section or, respectively, for the partial preliminary reaction in a pre-combustion chamber which is supplied with water.

BRIEF DESCRIPTION OF THE DRAWINGS

Additional features and advantages of the invention will become more readily apparent from the following detailed description of preferred embodiments for a construction of a hydrodynamic propulsion device according to the invention, taken in conjunction with the accompanying drawings; in which.

DETAILED DESCRIPTION

Figure 1:
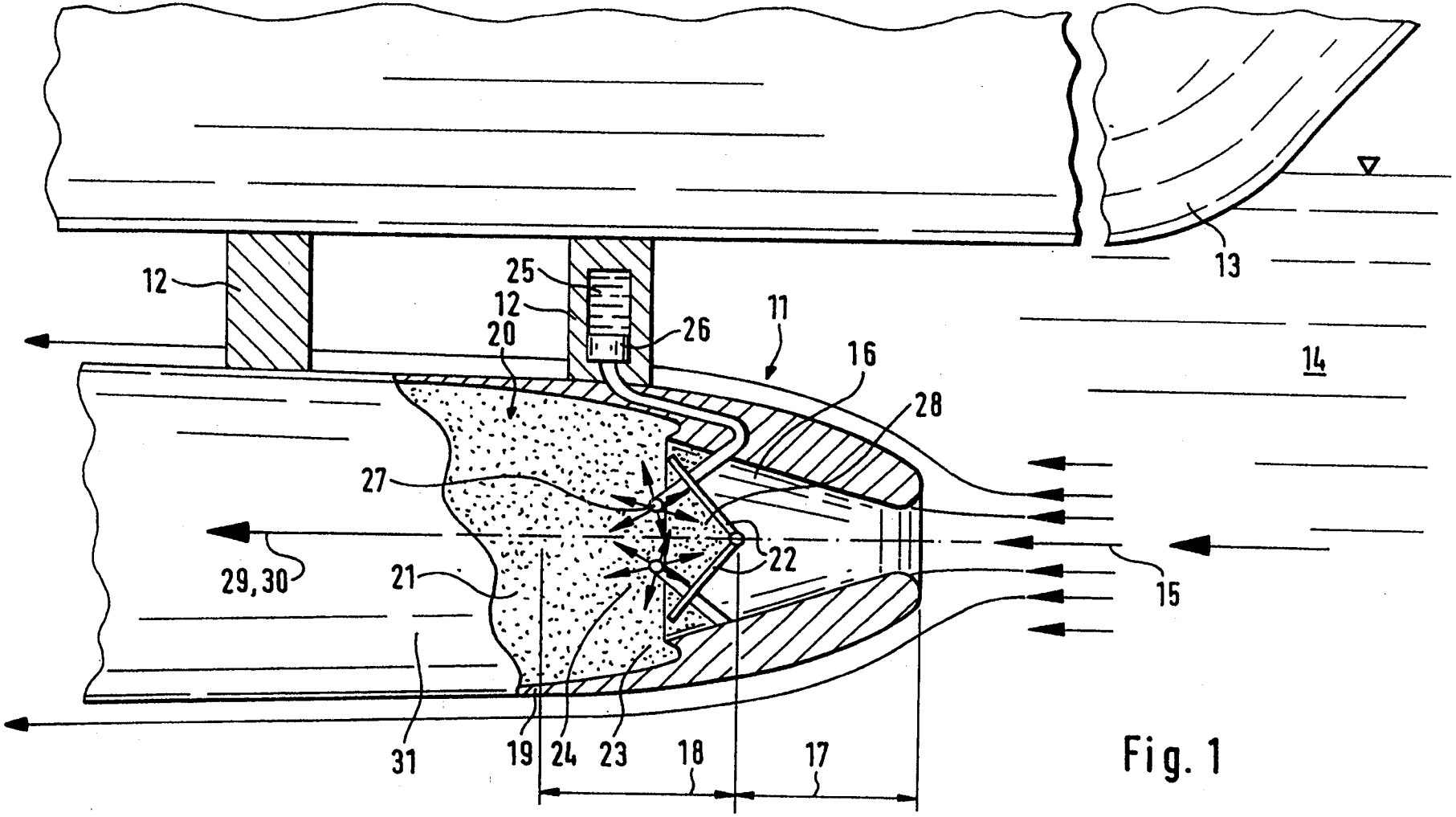
FIG. 1 illustrates a longitudinal sectional view of a thrust cell with a first embodiment of a mixing section.

As diagrammatically shown in FIG. 1, hydrodynamic propulsion devices 11 in the form of hydrofuel thrust cells are attached by means of mounting elements 12 to the hull 13 of either a surface or underwater vessel, or alternatively can be disposed in a concentric annular configuration attached to the stern or tail end of a generally torpedo-shaped body which is intended to travel submerged, in the form of a therewith integrated propulsion device 11 (as shown in FIG. 5 of German Patent No. 34 35 076). In any event, the propulsion device 11 is in itself surrounded by an incompressible medium, ordinarily water. From the water 14, which is at ambient temperature, an incident flow 15 thereof passes into the intake region 17 of the propulsion device 11, with the intake region 17 being in the form of a diffuser 16. The widening cross-sectional geometry of the intake region 17 causes a reduction in the velocity of the flow with an increase in pressure resulting therefrom upon reaching the mixing section 18 which is disposed downstream of the intake region 17 in the direction of the flow. A compressible medium 20 is produced in the incompressible incoming flow 15 within the mixing section 18, with the compressible medium 20 being in the form of a multi-phase flow produced from the incoming flow 15 (in a preferred instance, water), created of an intense throughput with fine vapor and gas bubbles 21. For that purpose, at the transition between the intake region 17 and the mixing section 18, in order to generate a turbulence in the slowed-down incoming flow 15 there are installed flow obstructions 22 which, together with a widening 23 in the cross-section, result in an intense dead water turbulence or swirling, such as eddying, in the slowed-down incoming flow 15. A material which reacts strongly with the fluid, such material being generally referred to herein as hydrofuel 28, is injected into the above-mentioned flow eddies or turbulence 24 which slowly drift off by virtue of an additional cross-sectional widening, and whereby the injected hydrofuel received from a supply tank 25 by means of a pump 26 is then injected through nozzles 27. The nozzles 27 are positioned and oriented in such a manner, expediently directly adjoining the flow obstructions 22, such that the entire cross-section of the slowed-down incoming flow 15 is affected by hydrofuel jets 28, with the least possible speed components in the direction of the discharging flow 29. Due to the presence of an adequate dwelling time for the drifting-off flow eddies or turbulence 24, this produces the desired effect of filling the cross-section with a large quantity or multiplicity of very small-sized reaction gas bubbles 22 prior to the compressible multi-phase medium produced thereby being again accelerated under a reduction in pressure in the downstream adjoining and reducing mixing section discharge nozzle 19, in order to thereafter discharge in the form of a constant operating jet 30. A stern diffuser 31 for reducing the velocity of the flow can be connected downstream of the discharge nozzle 19.

Accordingly, it is significant with regard to the functioning of the propulsion device 11 pursuant to the invention that the incident incompressible medium, such as water, is converted in the mixing section into the most possibly homogeneous compressible multi-phase mixture 20 consisting of water, reaction gas (hydrogen) and vapor, responsive to the reaction of the hydrofuel 28. Only this compressible multi-phase mixture enables work to be absorbed; and this is a crucially important consideration, to be capable of delivering work.

As a good approximation, there can be assumed that in view of thermal conduction within the water, which is negligible up to the vaporization taking place at the edge of the reaction gas bubbles, heating of the water does not take place. The multi-phase mixture 20 also leads to considerably reduced friction losses, so that at the discharge end, it is possible that with a good degree of approximation there can be assumed the presence of a steady adiabatic flow with constant phase velocities of all components of the multi-phase mixture 20 over the entire flow cross-section. When sufficiently small-sized hydrofuel droplets are introduced in a homogeneously distributed manner into the water in the mixing section 18, this results in a correspondingly fast stoichiometric reaction up to the vaporization of the water at the surfaces of the reaction gas bubbles, and thereby leads to an isobaric energy supply in the mixing section 18. The small hydrofuel bubbles which are introduced into the water in the mixing section, which are distributed therein as homogeneously as possible, are relatively insensitive to any change in ambient pressure due to their stability, so that a mixture prepared in that manner reacts in a more reproducible or controllable fashion and is substantially more independent of the depth of water than the previously-mentioned large-sized bubbles for separating a water piston or column out of the incoming flow. The water vapor which is formed through the bubble volume is an essential component of the effective operating medium, whereas the non-vaporized water is again discharged into the surroundings at a temperature which practically does not increase. The large excess amount of water acts as a supporting mass in order for the operating medium also to actually deliver its energy in the propulsion device 11, and is not simply subjected to the effects of turbulence without producing a considerable amount of thrust. Irrespective of the depth of the water, the pressure in the chamber which determines the thrust is determined by the velocity of the incoming flow and can be basically increased by flow obstructions which act in dependence upon direction (with a low level of resistance in the flow direction, while possessing a high level of resistance in an oppositely directed relationship with the flow direction).

Figure 2:
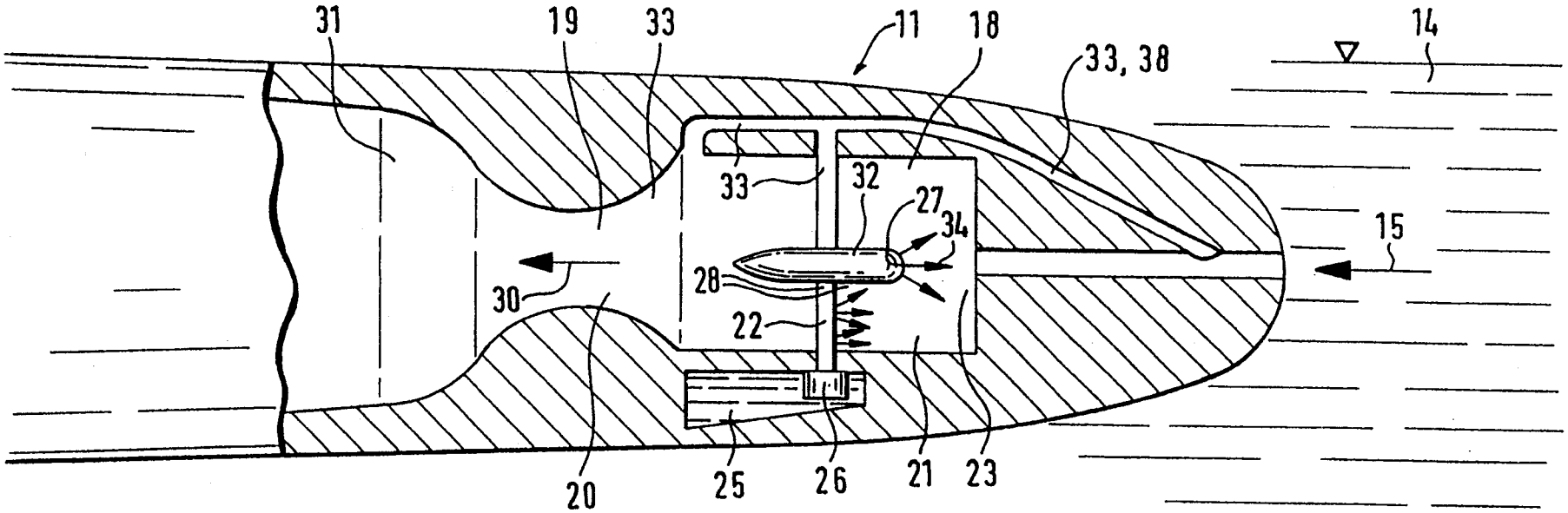
FIG. 2 illustrates a view similar to FIG. 1 of a second embodiment of a thrust cell.

The particular embodiment of the propulsion device 11 shown in FIG. 2 differs from that of FIG. 1 in that in the mixing section 18 downstream of the cross-sectional widening 23 there is disposed a pre-combustion chamber 32 for effecting the partial combustion of the hydrofuel 28 which is pumped in from the supply tank 25 and which is supplied in addition to the charge with the second reaction component; in essence, with water 33 which can be supplied from a separate tank or, as illustrated herein, which can be branched off from the incoming flow 15 through a by-pass conduit 38. The reaction mixture 34 is sprayed in from the pre-combustion chamber 32 through nozzles 27, and whereby the remainder of the hydrofuel 28 is subjected to further combustion in the reaction mixture 34. That supplementary reaction in the actual mixing section 18 can be additionally propagated by a process in which hydrofuel 28 is again injected directly into the incoming flow 15 downstream of the cross-sectional widening 23 through nozzles 27 which are distributed over a large area while supported on ribs or similar flow obstructions 22 which are in any case ordinarily constructively located therein.

In order, on the one hand, to increase the dwelling time for the incoming flow 15 in the mixing section 18, and consequently the time enabling a reaction to take place while, on the other hand, providing fresh reaction water 33 for a remaining reaction in the interest of providing a medium 20 which is as gas-rich as possible, additional water 33 is introduced through a by-pass conduit 38 into the rearward region of the mixing section 18, in effect, downstream of the pre-combustion chamber 32 which is of a configuration promoting a good rate of flow. This serves as a supporting mass and post-combustion material for the two-phase medium 20 from the mixing section 18 which, heretofore, has only partially reacted and which has accordingly remained reaction-friendly. This supplementary reaction taking place downstream of the pre-combustion chamber 32 results in an increase in the bubble volume with reaction gas and water vapor.

Figure 3:
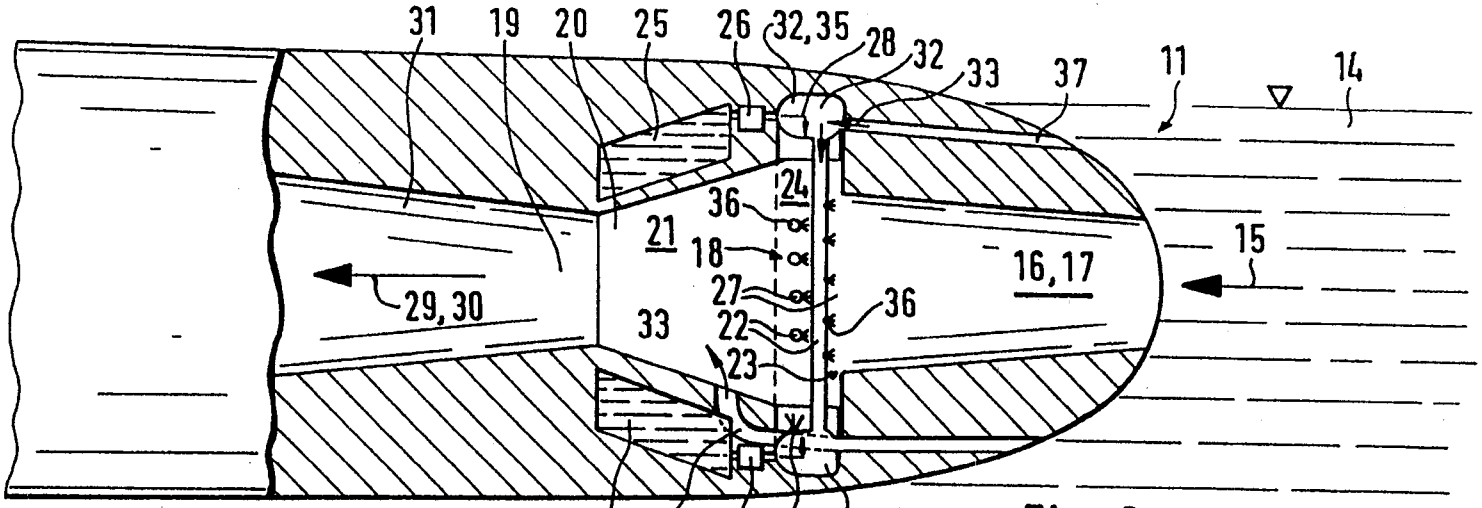
FIG. 3 illustrates a further modification of a similar thrust cell.
Figure 4:
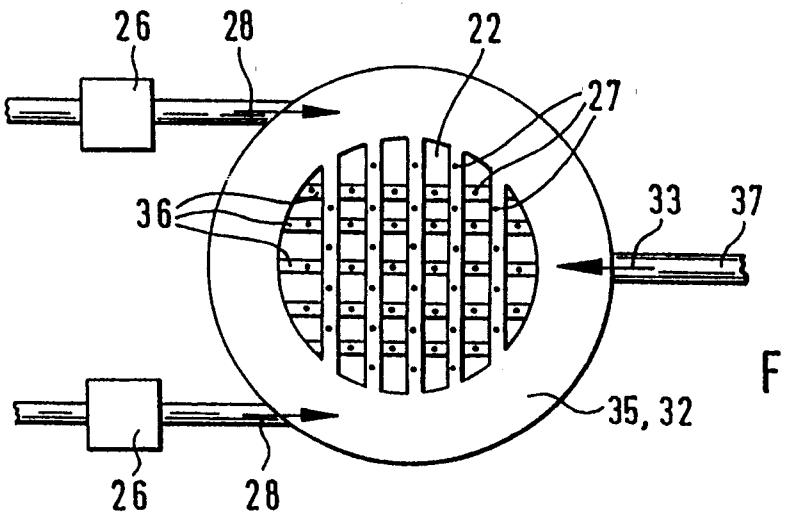
FIG. 4 illustrates a view taken in the direction of incident flow of a hydrofuel injection arrangement pursuant to FIG. 3.

In the embodiment shown in FIG. 3, which is modified particularly with regard to the flow obstructions 22 having the hydrofuel injection nozzles 27 integrated therein, the apparatus now possesses an annular passage or duct 35 which coaxially surrounds the mixing section 18 instead of in a coaxially central pre-combustion chamber 32 as shown in FIG. 2 so as to produce a reaction gas bubble distribution which is as homogeneous and rapid as possible in the short mixing section 18 downstream of the cross-sectional widening 23. The annular duct 35 supplies thin feed pipes or conduits 36 which extend in parallel with a diameter of the annular duct and also transversely thereof (offset in the direction of the incoming flow 15), and all of which pipes open at both ends into the annular duct 35. From the annular duct, the feed pipes 36 are supplied from supply tanks 25 with gaseous, or preferably liquid hydrofuel 28 which egresses in fine pressurized jets from nozzles 27 in opposite direction to that of the incoming flow 15; in effect, in a direction towards the constant operating nozzle. The annular duct 35 serves as a pre-combustion chamber in the event that water 33 is introduced therein; for example, through a pressure tube 37, because the hydrofuel 28 which is to be injected into the mixing section 18 has already been previously subjected to an incomplete pre-combustion in order to produce a more rapid reaction in the mixing section 18 itself. In this case, it may be expedient for water 33 to again be introduced between the mixing section 18 and the discharge nozzle 19 through a by-pass 38 in order to provide a damming effect with regard to the medium 20 in the mixing section 18, and to also provide for post-combustion of the stoichiometrically excessively present components of hydrofuel 28. Instead of the feed pipes 36 which extend in a crossing configuration, it is also possible to provide annularly extending pipes. Annularly extending pipes are adapted to be arranged in the mixing section 18 at spacings relative to each other and at their peripheries possess nozzles for the hydrofuel 28. Annularly extending pipes of that type are substantially more advantageous with regard to flow conditions than are the feed pipes 36.

What is claimed is:

1. A hydrodynamic propulsion device comprising an expansion chamber located downstream of a cross-sectional widening of an interior passage for a flow of medium which is to be expelled from a discharge nozzle; injection means for producing a working medium gas through a reaction of a hydrofuel with water within the propulsion device, said expansion chamber including a mixing section extending along the flow of said medium through said expansion chamber for injection of jets of said hydrofuel into said mixing section to produce a multi-phase mixture of water and gas which is homogeneously distributed over the cross-section of the medium flow so as to generate a constant jet producing a steady thrust; feed pipes forming flow obstructions in said mixing section and supports for injection nozzles arranged at said flow obstructions and being distributed over the cross-section of said mixing section; and a pre-combustion chamber being communication with the mixing section and implementing a substoichiometric reaction of hydrofuel.

2. A propulsion device according to claim 1, wherein said hydrofuel comprises NaK.

3. A propulsion device according to claim 1, wherein a diffuser effects a reduction in the velocity of the medium flow preceding said medium flow being placed into a turbulent condition in said mixing section.

4. A propulsion device according to claim 1, wherein auxiliary conduit means introduces additional water as a supporting and post-combustion material into a transitional region between said mixing section and said discharge nozzle.

5. A propulsion device according to claim 1, wherein an annular duct arranged concentrically around the mixing section comprises said pre-combustion chamber.

6. A propulsion device according to claim 1, wherein said injection means injects hydrofuel into said mixing section in a direction opposite the direction of the medium inflow.

7. A propulsion device according to claim 1, wherein said feed pipes extend in mutually crossing relationship within planes that are offset relative to each other, said pipes having ends connected to mutually oppositely disposed regions of an annular duct which extends concentrically around said mixing section.

8. A propulsion device according to claim 6, wherein said means injects said hydrofuel radially into said mixing section.

9. A propulsion device according to claim 6, wherein said injection means injects said hydrofuel in axially-parallel relationship with a longitudinal axis of said mixing section.

10. A propulsion device according to claim 6, wherein said means injects partially reacted hydrofuel into said mixing chamber.

* * * * *

UNITED STATES PATENT AND TRADEMARK OFFICE

CERTIFICATE OF CORRECTION

PATENT NO. : 5,421,153

DATED : June 6, 1995

INVENTOR(S) : Ulrich Schleicher, et al.

It is certified that error appears in the above-indentified patent and that said Letters Patent is hereby corrected as shown below:

Column 6, line 57, Claim 1: after "for" insert --the--

Column 6, line 64, Claim 1: after "nozzles" insert --comprising said injection means--

Column 6, line 66, Claim 1: after "being" insert --in--

Column 8, line 17, Claim 10: after "said" insert --injection--

Column 8, line 18, Claim 10: "chamber" should read --section--

Signed and Sealed this

Nineteenth Day of March, 1996

Bruce Lehman

*Attest:*

BRUCE LEHMAN

*Attesting Officer*

*Commissioner of Patents and Trademarks*